US007270324B2

(12) United States Patent
Ogata et al.

(10) Patent No.: US 7,270,324 B2
(45) Date of Patent: Sep. 18, 2007

(54) SHEET STACKING APPARATUS AND IMAGE FORMING APPARATUS

(75) Inventors: Atsushi Ogata, Shizuoka (JP); Masayoshi Fukatsu, Shizuoka (JP); Junichi Sekiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 294 days.

(21) Appl. No.: 10/875,214

(22) Filed: Jun. 25, 2004

(65) Prior Publication Data

US 2005/0035535 A1 Feb. 17, 2005

(30) Foreign Application Priority Data

Jul. 15, 2003 (JP) ..... 2003-197088

(51) Int. Cl.
*B65H 31/26* (2006.01)

(52) U.S. Cl. ..... 271/220; 271/176; 271/207

(58) Field of Classification Search ..... 271/176, 271/220, 207

See application file for complete search history.

(56) References Cited

U.S. PATENT DOCUMENTS

| | | | | |
|---|---|---|---|---|
| 6,170,821 | B1 * | 1/2001 | Kubota | 271/288 |
| 6,302,606 | B1 | 10/2001 | Hayakawa et al. | 400/625 |
| 6,318,718 | B1 | 11/2001 | Ogata et al. | 271/213 |
| 6,382,616 | B1 | 5/2002 | Waragai et al. | 270/58.12 |
| 6,394,448 | B2 * | 5/2002 | Suzuki et al. | 271/189 |
| 6,661,995 | B2 | 12/2003 | Isobe et al. | 399/410 |
| 6,663,102 | B2 * | 12/2003 | Takahashi et al. | 271/217 |
| 7,055,818 | B2 * | 6/2006 | Furusawa | 271/220 |
| 2003/0185612 | A1 | 10/2003 | Sekiyama et al. | 399/405 |
| 2004/0022567 | A1 | 2/2004 | Fukatsu et al. | 399/405 |
| 2004/0080739 | A1 | 4/2004 | Sekiyama et al. | 355/407 |
| 2004/0104528 | A1 | 6/2004 | Fukatsu et al. | 271/207 |

FOREIGN PATENT DOCUMENTS

| | | |
|---|---|---|
| JP | 61-217462 | 9/1986 |
| JP | 2001-72302 | 3/2001 |

* cited by examiner

*Primary Examiner*—Patrick Mackey
*Assistant Examiner*—Kaitlin S Joerger
(74) *Attorney, Agent, or Firm*—Fitzpatrick, Cella, Harper & Scinto

(57) ABSTRACT

A sheet stacking apparatus including a sheet stacking tray for stacking sheets thereon, a first abutting member for abutting against the upper surface of the sheets stacked on the sheet stacking tray, and a second abutting member for abutting the underside of the sheets stacked on the sheet stacking tray, wherein the first abutting member operates in operative association with the operation of the second abutting member.

7 Claims, 8 Drawing Sheets

SHEET STACKING APPARATUS AND IMAGE FORMING APPARATUS

BACKGROUND OF THE INVENTION

1. Field of the Invention

The invention relates to the sheet discharging portion of an image forming apparatus such as a printer, and the construction of the sheet discharging portion of a sheet post-treating apparatus connected to the image forming apparatus.

2. Description of the Related Art

The discharging portion of an image forming apparatus or a sheet post-treating apparatus has a stacking tray for stacking discharged sheets thereon, and the stacking tray is usually inclined so that the downstream side thereof with respect to a sheet discharging direction may be above.

This intends to cause discharged sheets to slide down on the stacking tray in a direction opposite to a conveying direction after they are stacked on the stacking tray, and cause the trailing ends of the sheets to strike against a stacking wall provided on the upstream side of the tray, thereby snugly aligning the sheets in their stacked state and improving their outward appearance and handling property.

Also, like the invention described in Japanese Patent Application Laid-Open No. 2001-72302, there has been an apparatus provided with a stack height detecting lever provided so as to abut against the uppermost surface of sheets in order to detect the height of the sheets stacked on a stacking tray, and a sheet presence or absence detecting lever designed to protrude from the stacking tray and abut against the underside of the sheets, and be operated by the gravity of the sheets.

In the invention described in Japanese Patent Application Laid-Open No. 2001-72302, however, for each of the detecting lever for detecting the stack height and the detecting lever for detecting the presence or absence of the sheets, a sensor for detecting the position of the lever and a cable therefor becomes necessary, and this has caused an increase in cost.

SUMMARY OF THE INVENTION

The present invention has been made in order to solve such a problem, and an object thereof is to provide a sheet stacking apparatus which can detect the position of a detecting lever to thereby detect the presence or absence and stack height of sheets on a stacking tray.

The present invention provides a sheet stacking apparatus having a sheet stacking tray for stacking sheets thereon, a first abutting member for abutting against the upper surface of the sheets stacked on the sheet stacking tray, and a second abutting member for abutting the underside of the sheets stacked on the sheet stacking tray, wherein the first abutting member operates in operative association with the operation of the second abutting member.

Also, the present invention provides an image forming apparatus having an image forming portion for forming images on sheets, a discharging member for discharging the sheets on which the images have been formed by the image forming portion, a sheet stacking tray for stacking thereon the sheets discharged by the discharging member, a first abutting member for abutting against the upper surface of the sheets stacked on the sheet stacking tray, and a second abutting member for abutting against the underside of the sheets stacked on the sheet stacking tray, wherein the first abutting member operates in operative association with the operation of the second abutting member.

Other objects and features of the present invention will become apparent from the following description and the accompanying drawings.

DESCRIPTION OF THE PREFERRED EMBODIMENTS

Some preferred embodiments of the invention will hereinafter be described in detail by way of example with reference to the accompanying drawings. However, the dimensions, materials, shapes, relative disposition, etc. of constituent parts described in the embodiments are not intended to restrict the scope of this invention thereto.

First Embodiment

A discharging apparatus according to a first embodiment of the present invention will first be described with reference to FIGS. 1 to 9.

Figure 1:
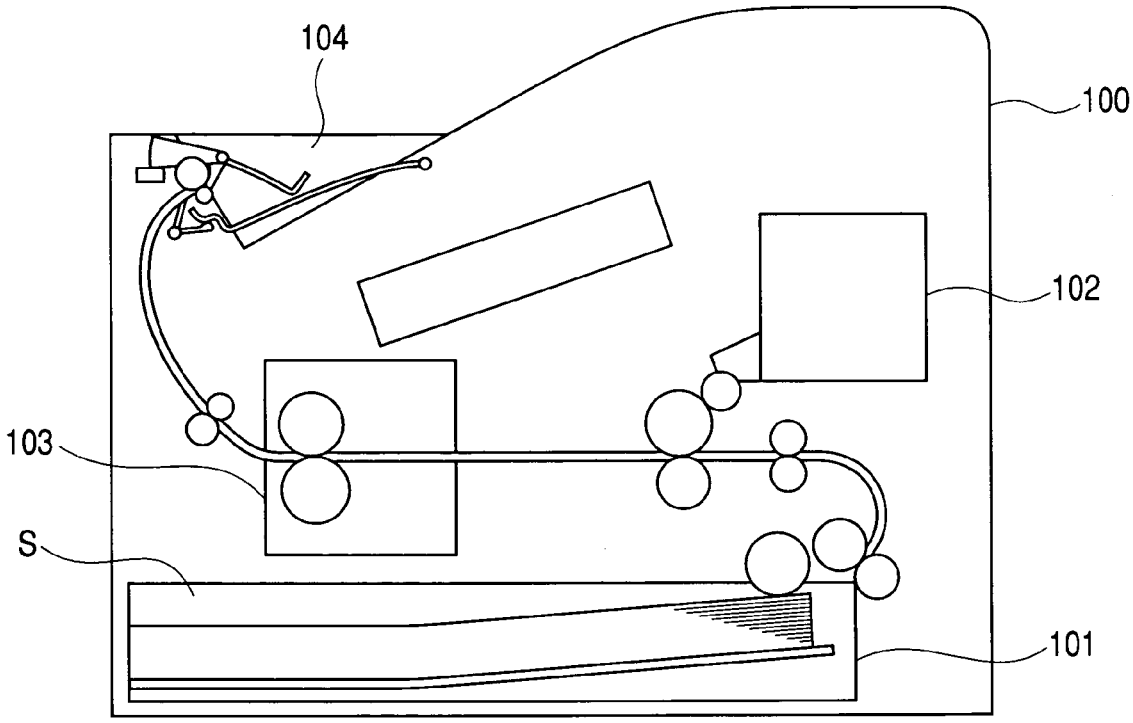
FIG. 1 is a side cross-sectional view of an image forming apparatus according to a first embodiment of the present invention.

In FIG. 1, an image forming apparatus 100 is connected singly to a computer or a network such as LAN, and is designed to form (print) an image on a sheet S by a predetermined image forming process on the basis of image information, a print signal or the like sent from the computer or the network, and discharge the sheet S to a sheet stacking portion 104.

In the present embodiment, during image forming, the sheets S stacked in a feed cassette 101 are fed one by one to an image forming portion 102 for forming a toner image by an image forming process of a so-called laser beam type by various rollers, and in this image forming portion 102, the toner image is transferred to the upper surface of the sheet, and subsequently, heat and pressure are applied to the sheet by a fixing device 103 on the downstream side, whereby the toner image is permanently fixed.

Figure 2:
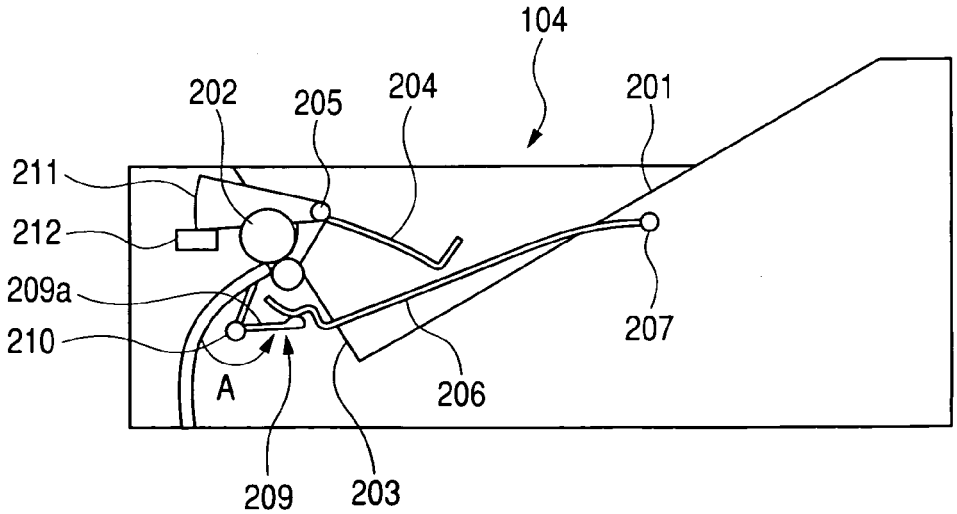
FIG. 2 is a side cross-sectional view of a sheet stacking portion according to the first embodiment of the present invention.
Figure 3:
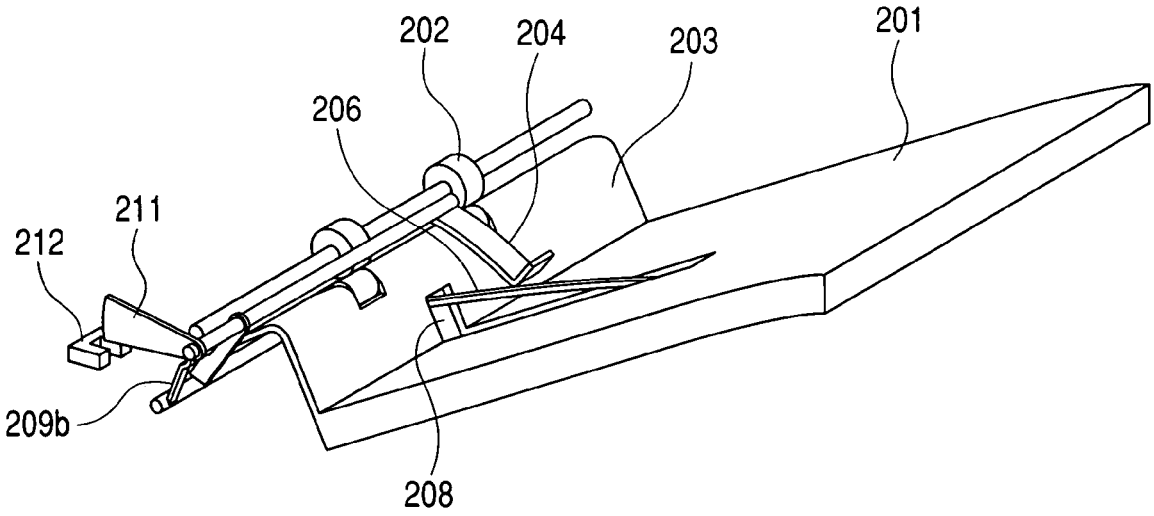
FIG. 3 is a perspective view of the sheet stacking portion according to the first embodiment of the present invention.

FIG. 2 is a side cross-sectional view showing the construction of the sheet stacking portion 104 of the image forming apparatus 100, and FIG. 3 is a perspective view showing the construction of the sheet stacking portion 104.

In FIGS. 2 and 3, a stacking tray 201 is inclined so that the downstream side thereof with respect to a discharging direction may be above, and the sheet S discharged by a pair of discharge rollers 202 is stacked on the stacking tray 201 while being rammed against a rear end wall 203.

A stack height detecting lever 204 is provided for pivotal movement about a pivot shaft 205 provided above the pair of discharge rollers 202, so that the tip end of the lever may abut against the sheet stacked on the stacking tray 201.

The tip end of the stack height detecting lever 204 is of such a guide shape as will guide the leading edge of the sheet to under the stack height detecting lever 204 when the sheet is inserted from the downstream side with respect to a conveying direction into the stacking tray 201.

Also, a sheet presence or absence detecting lever 206 is provided for pivotal movement about a pivot shaft 207 below the stacking surface of the stacking tray 201 and downstream of the rear end wall.

The tip end of the sheet presence or absence detecting lever 206 reaches the back side of the rear end wall 203 part a slit 208 provided in the rear end wall 203.

A link member 209 is provided in the interior of the rear end wall 203, and is pivotally movable about a pivot shaft 210, and one end 209*a* of the link member 209 abuts against the tip end of the sheet presence or absence detecting lever 206, and further another end 209*b* of the link member 209 abuts against the stack height detecting lever 204.

The link member 209 is biased by a spring (not shown) in the direction indicated by the arrow A, whereby the sheet presence or absence detecting lever 206 is biased so as to be in a position protruding from the stacking surface in a state in which no sheet is stacked on the stacking tray 201.

The stack height detecting lever 204 has a portion 211 to be detected, and the portion 211 to be detected passes a sensor 212 by the rotation of the stack height detecting lever 204, whereby the operation of the stack height detecting lever 204 is detected.

Description will now be made of the operation of the thus constructed sheet stacking portion 104 during the stacking of the sheets.

When the sheet is discharged by the pair of discharge rollers 202, the leading edge of the sheet abuts against the stack height detecting lever 204, and the sheet is discharged onto the stacking tray 201 while rotating the stack height detecting lever 204.

Figure 4:
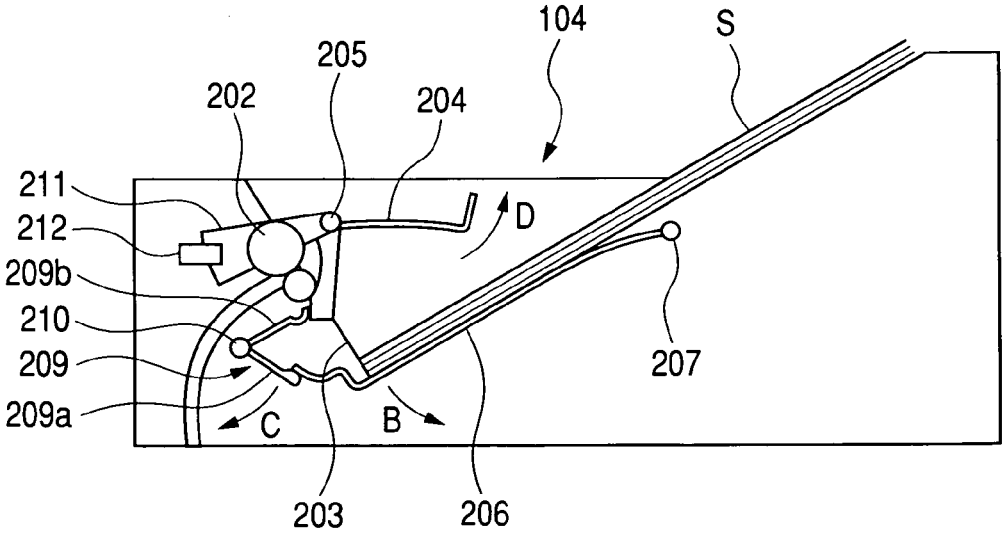
FIG. 4 is a side cross-sectional view of the sheet stacking portion according to the first embodiment of the present invention.

When the sheets are stacked, as shown in FIG. 4, the sheet presence or absence detecting lever 206 is pivotally moved to the underside of the stacking surface in the direction indicated by the arrow B by the gravity of the sheets, whereby the link member 209 is pivotally moved in the direction indicated by the arrow C and further, the stack height detecting lever 204 is pivotally moved in the direction indicated by the arrow D, whereupon the portion 211 to be detected is detected by the sensor 212, and it is detected that the sheets are present on the stacking tray 201.

Figure 5:
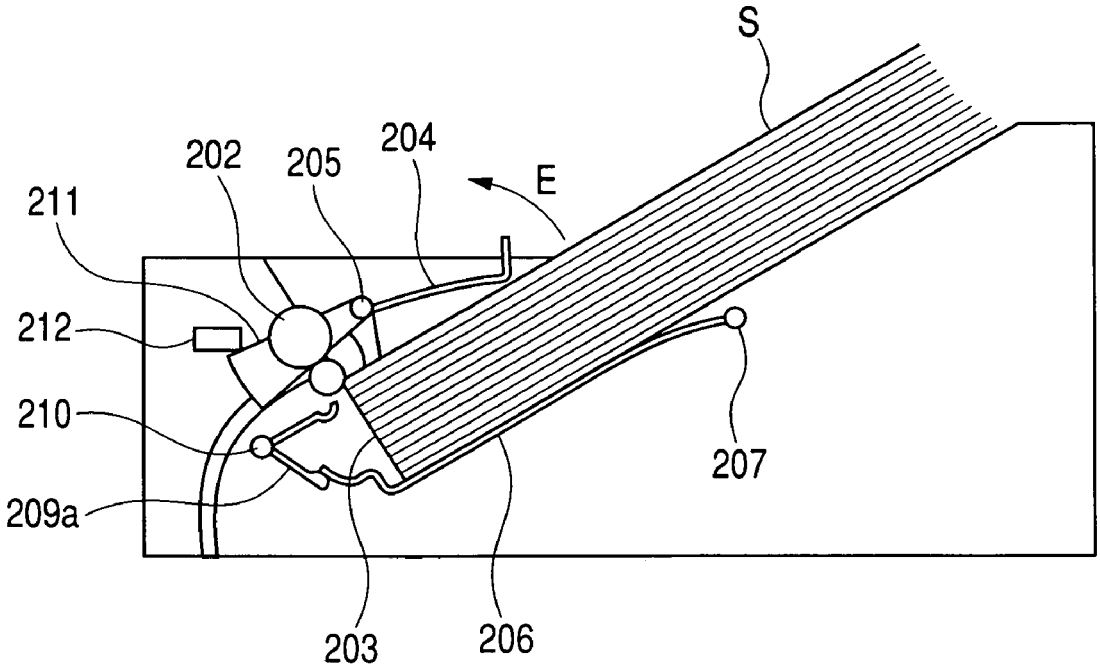
FIG. 5 is a side cross-sectional view of the sheet stacking portion according to the first embodiment of the present invention.

When the sheets are successively discharged and as shown in FIG. 5, a predetermined amount of sheets are stacked on the stacking tray 201, the stack height detecting lever 204 is further pivotally moved in the direction indicated by the arrow E and the portion 211 to be detected assumes a position in which it is not detected by the sensor 212, and it is detected that the sheets have reached a predetermined amount.

Figure 6:
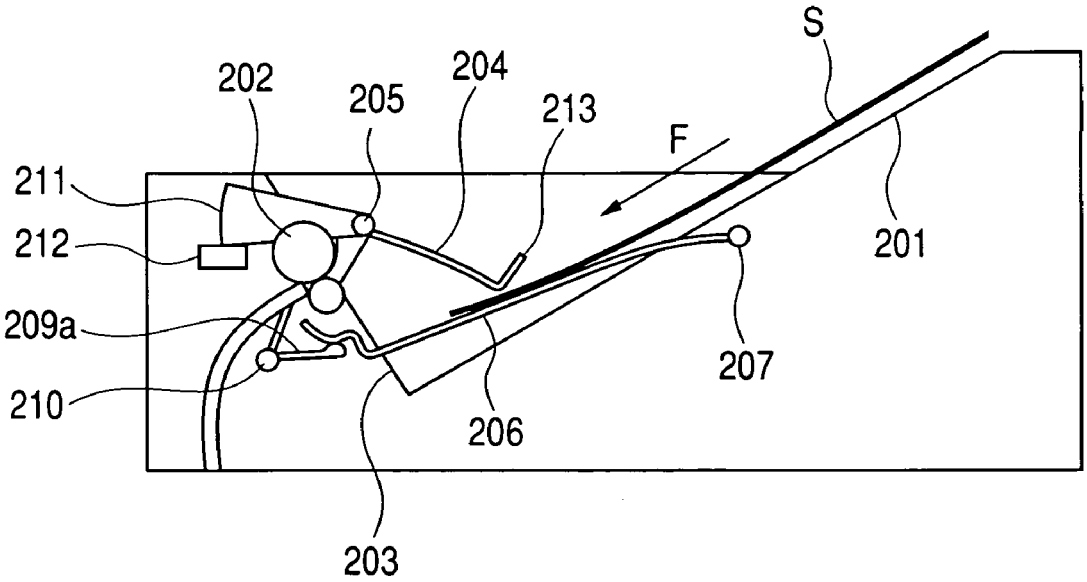
FIG. 6 is a side cross-sectional view of the sheet stacking portion according to the first embodiment of the present invention.

When as shown in FIG. 6, a sheet has been inserted from the downstream side with respect to the conveying direction onto the stacking tray 201, i.e., in the direction indicated by the arrow F, the sheet first becomes along the sheet presence or absence detecting lever 206, whereby the sheet presence or absence detecting lever 206 is pivotally moved, and in operative association therewith, the stack height detecting lever 204 is pivotally moved and is retracted relative to the insertion of the sheet and also, the tip end 213 of the stack height detecting lever 204 is of an upwardly curved shape so as to downwardly guide the leading edge of the sheet, whereby the sheet is guided to the underside of the stack height detecting lever 204.

Figure 7:
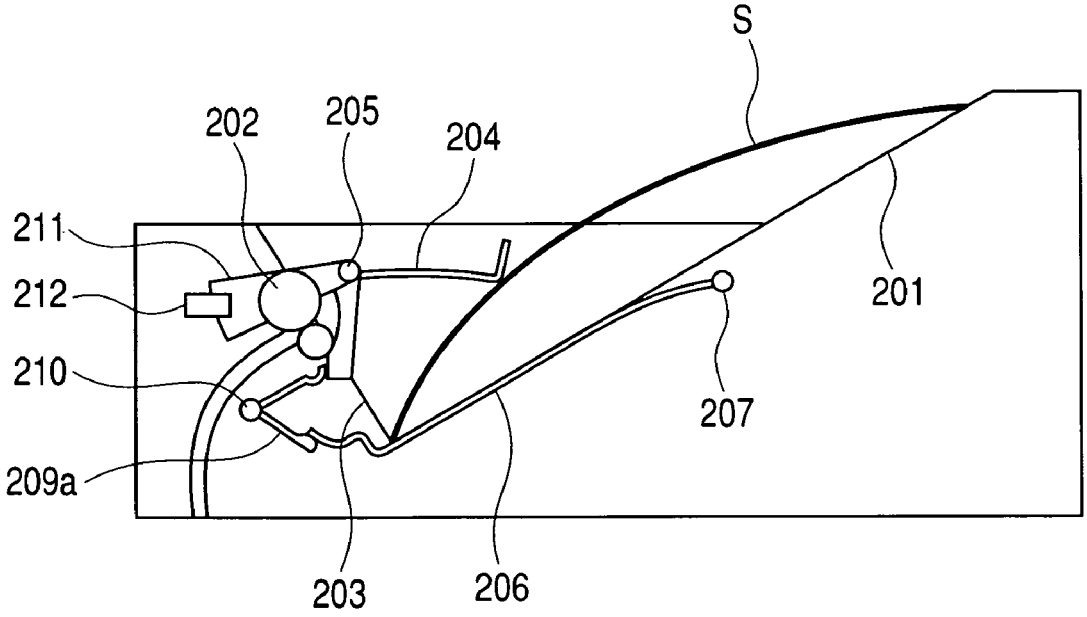
FIG. 7 is a side cross-sectional view of the sheet stacking portion according to the first embodiment of the present invention.
Figure 8:
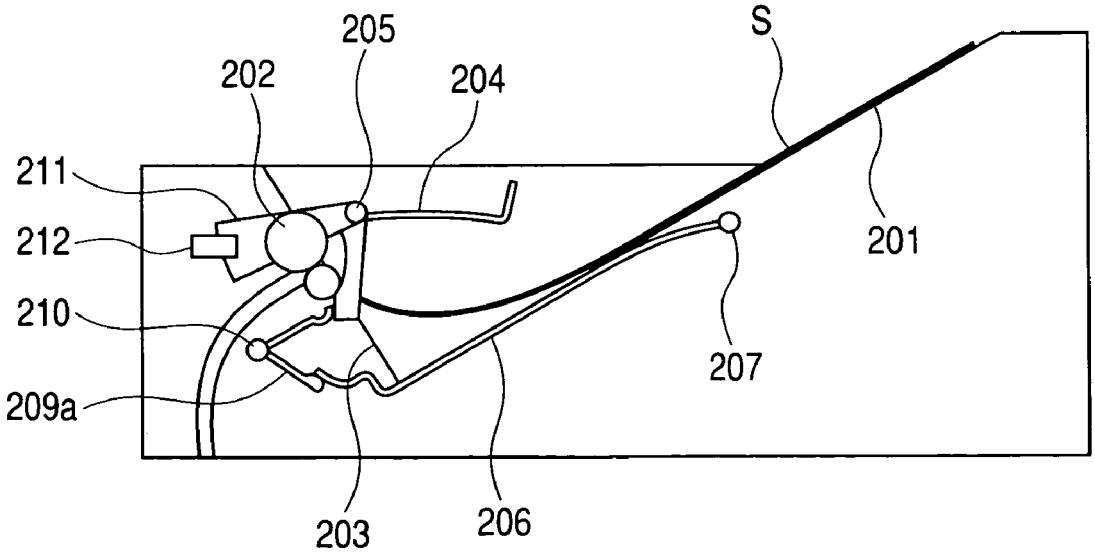
FIG. 8 is a side cross-sectional view of the sheet stacking portion according to the first embodiment of the present invention.

The sheet presence or absence detecting lever 206 has its center of pivotal movement on the downstream side with respect to the conveying direction and reaches the inner side of the rear end wall 203, whereby from the state of the sheet such as curl, it can be detected that the sheets are stacked on the stacking tray 201, even in a state as shown in FIG. 7 wherein only the two portions, i.e., the trailing edge and leading edge of the sheet with respect to the conveying direction land on the stacking tray 201, or in a state as shown in FIG. 8 wherein conversely the trailing edge of the sheet leans on the rear end wall 203.

While in the present embodiment, description has been made of an embodiment of the sheet stacking portion of the image forming apparatus, similar description also applies to a sheet stacking portion such as a sorter or a sheet post-treating apparatus connected to the image forming apparatus.

In a sorter having a plurality of sheet stacking portions arranged at narrow intervals, except the uppermost sheet stacking portion, sheets stacked on a stacking tray, and the stack height detecting lever 204 and the sheet presence or absence detecting lever 206 become difficult to see and therefore, particularly in a case where as shown in FIG. 6, the sheet is inserted from the downstream side, the construction of the present invention is useful.

Figure 9:
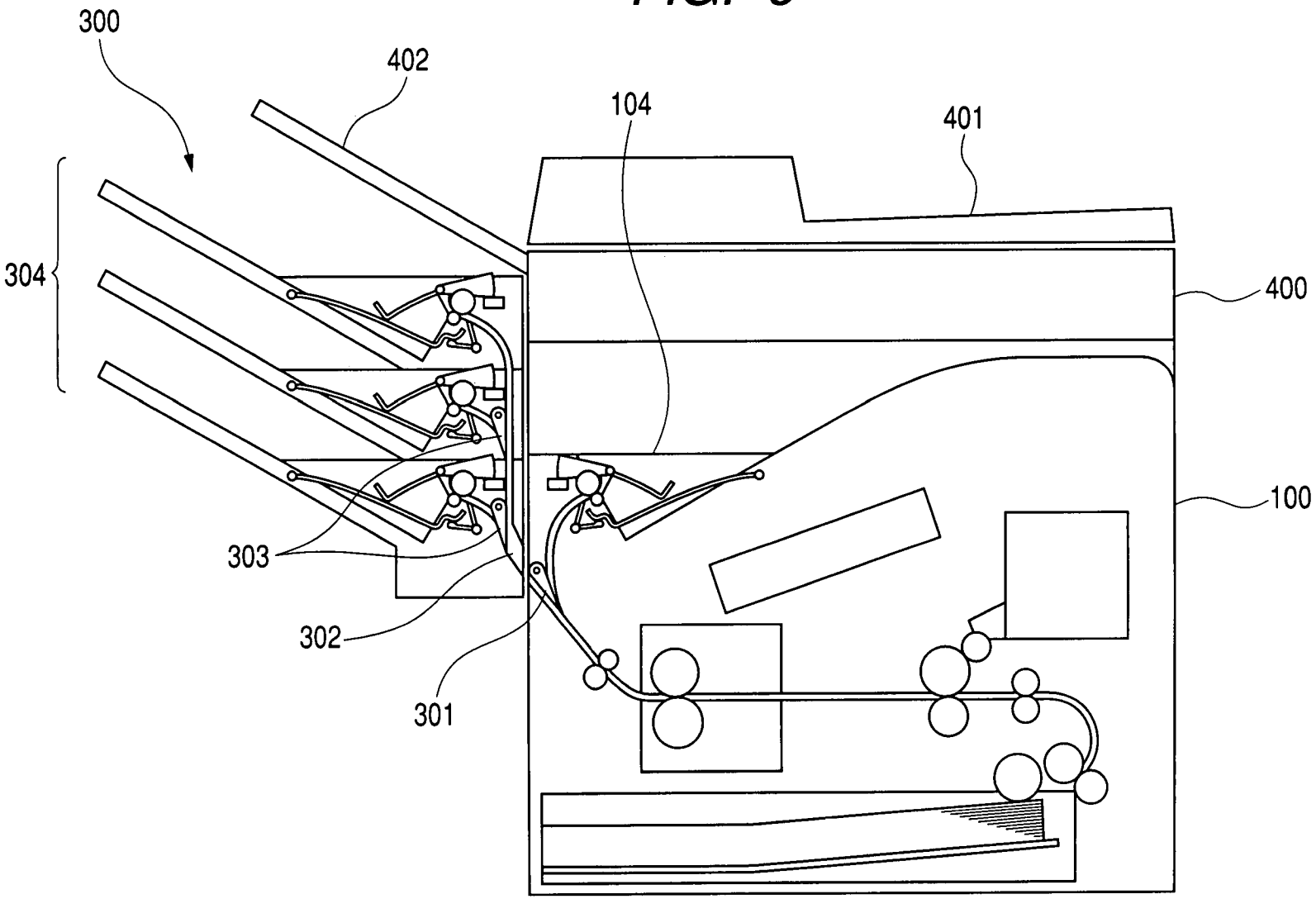
FIG. 9 is a side cross-sectional view of the sheet stacking portion according to the first embodiment of the present invention.

FIG. 9 shows a sorter 300 connected to a side of the image forming apparatus 100, and an image reading apparatus 400 connected to the upper portion of the image forming apparatus 100, and here, a sorter having three stacking trays, and the image reading apparatus 400 having an automatic original conveying apparatus 401 having an original discharging tray 402 on a side thereof are shown as examples.

A sheet having had its discharging direction designated to the sorter 300 by a flapper 301 in the image forming apparatus 100 is discharged from another discharge port 302 of the image forming apparatus 100, and thereafter is conveyed into the sorter 300.

In the sorter 300, the sheet is further discharged onto a stacking tray 304 designated by a flapper 303.

In a case where the sheet is discharged onto the uppermost tray of the stacking trays 304, the original discharging tray 402 becomes a hindrance, and in a case where the sheet is discharged to any other tray than the uppermost tray of the stacking trays 304, the more upper stacking tray becomes a hindrance, and in a state in which the sheet remains stacked on the tray, the contents of the sheet are difficult to discern from the outside and thus, it becomes often the case that the contents of the sheet are confirmed after the sheet has been taken out of the tray.

By the image reading apparatus 400 existing in the upper portion of the sheet stacking portion 104, this also holds true of the sheets stacked on the sheet stacking portion 104.

So, if the sheet taken out is not a desired one, it is returned to the tray, but the stack height detecting lever 204 and the sheet pressure or absence detecting lever 206 likewise become difficult to see from the outside and therefore, whether the sheet has been returned to an appropriate position cannot be confirmed and as a result, in the conventional method, the sheet has become a hindrance to the operations of the levers, and this has led to the possibility of becoming a cause of a faulty operation, jam or the like. By the construction of the present invention, however, in such a sorter wherein the levers are difficult to see, even when the sheet is returned to the tray from an opposite direction, it is possible to easily return the sheet to a predetermined position.

While in the present embodiment, the operative association between the sheet presence or absence detecting lever 206 and the stack height detecting lever 204 is effected through the link member 209, the sheet presence or absence detecting lever 206 may directly move the stack height detecting lever 204, or the two levers may be operatively associated with each other by another form of link member or through a driving member such as a gear.

Second Embodiment

Figure 10:
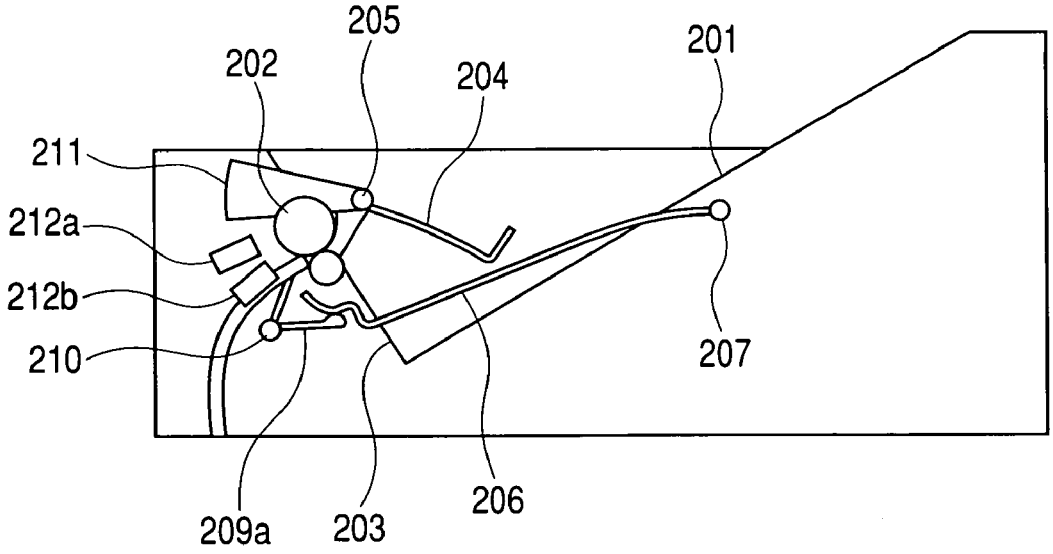
FIG. 10 is a side cross-sectional view of a sheet stacking portion according to a second embodiment of the present invention.
Figure 11:
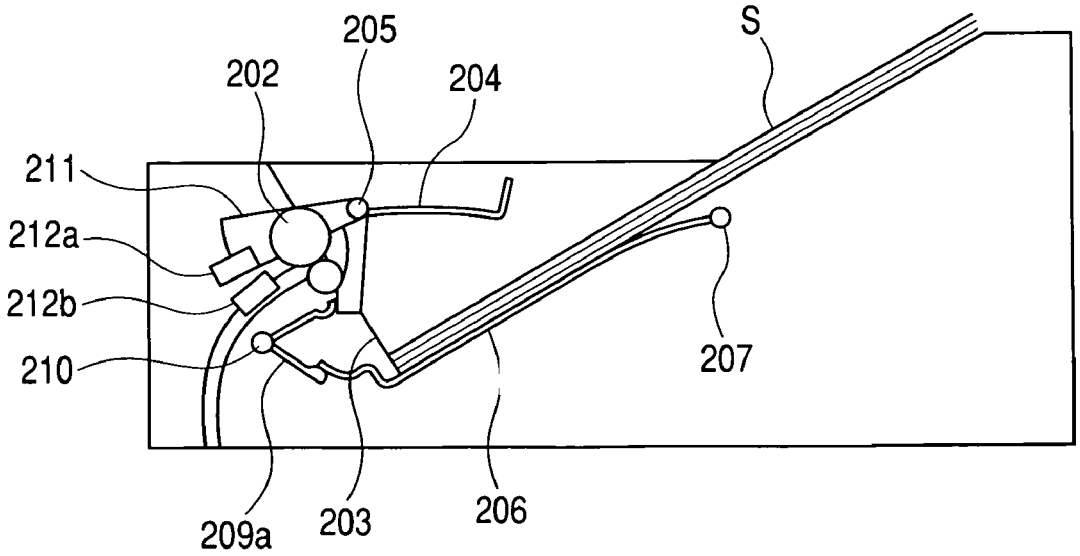
FIG. 11 is a side cross-sectional view of the sheet stacking portion according to the second embodiment of the present invention.
Figure 12:
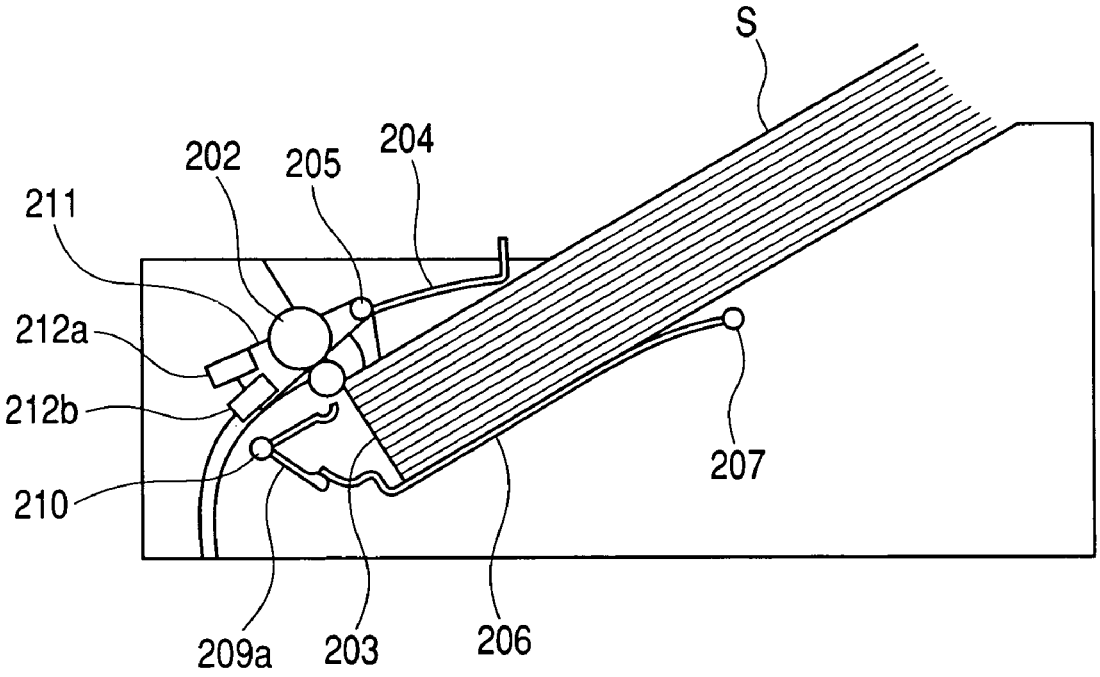
FIG. 12 is a side cross-sectional view of the sheet stacking portion according to the second embodiment of the present invention.

FIGS. 10 to 12 illustrate a second embodiment of the present invention.

As shown in FIG. 10, two sensors 212*a* and 212*b* are arranged side by side to detect the rotation of the stack height detecting lever 204.

Design is made such that the portion 211 to be detected is detected by neither of the two sensors in a state in which no sheet is stacked on the stacking tray 20 as shown in FIG. 10, and when as shown in FIG. 11, the sheets are present on the stacking tray, only the sensor 212*a* detects, and when as shown in FIG. 12, the sheets reach a predetermined amount, both of the sensors 212*a* and 212*b* detect.

Thereby, the state of the sheets on the stacking tray 201 can be detected more reliably.

Third Embodiment

Figure 13:
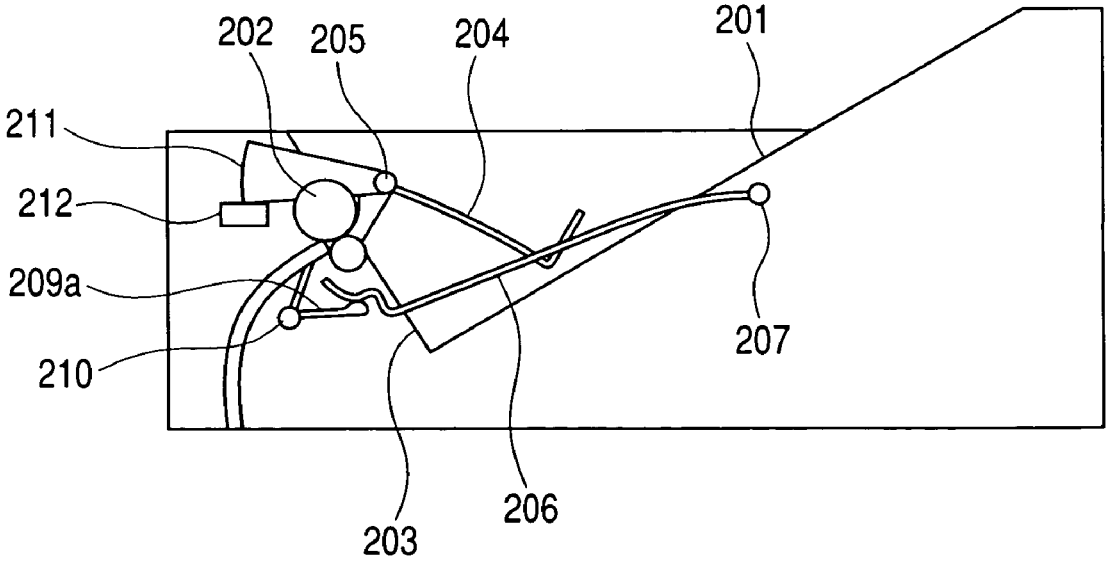
FIG. 13 is a side cross-sectional view of a sheet stacking portion according to a third embodiment of the present invention.
Figure 14:
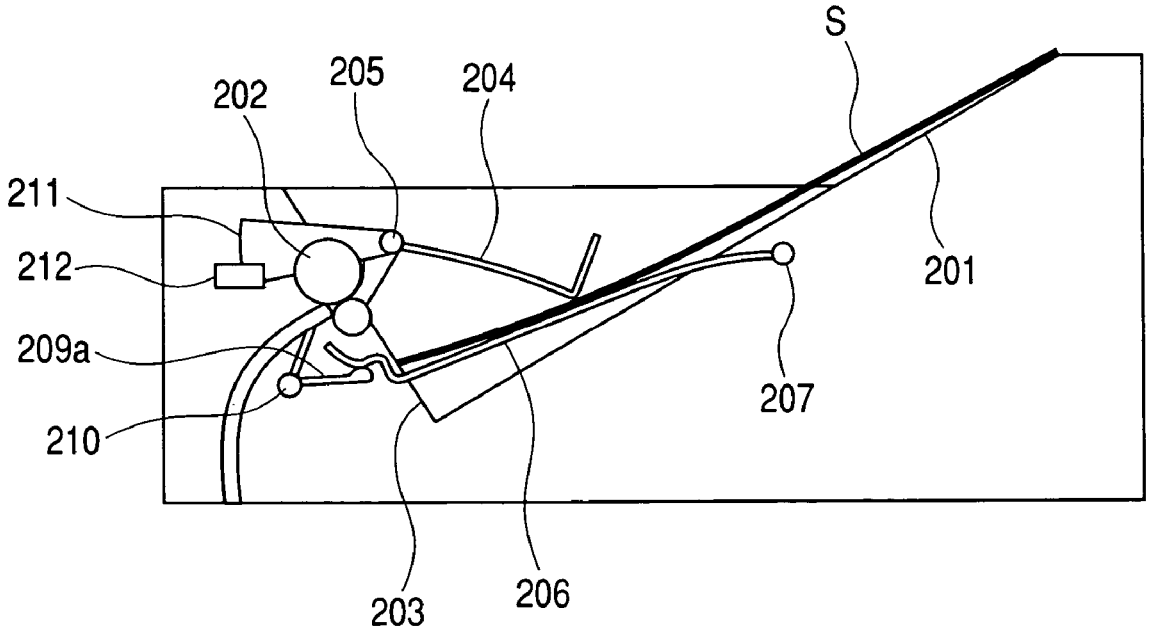
FIG. 14 is a side cross-sectional view of the sheet stacking portion according to the third embodiment of the present invention.

FIGS. 13 and 14 illustrate a third embodiment of the present invention.

Design is made such that in a state in which no sheet is stacked on the stacking tray 201, the tip end of the stack height detecting lever 204 is below the upper surface of the sheet presence or absence detecting lever 206, as shown in FIG. 13. That is, the stack height detecting lever 204 and the sheet presence or absence detecting lever 206 are in a state in which they intersect with each other.

When such a very light sheet that the sheet presence or absence detecting lever 206 does not operate is stacked, only the stack height detecting lever 204 is rotated by the sheet stacked on the sheet presence or absence detecting lever 206 as shown in FIG. 14 since the tip end of the stack height detecting lever 204 is below the sheet presence or absence detecting lever 206, and the portion 211 to be detected is detected by the sensors 212, whereby the presence of the sheet is detected.

Thereby, it can be detected more reliably that the sheet is present on the stacking tray 201.

As described above, according to the present embodiment, it is possible to detect the presence or absence and the stack height of the sheets on the stacking tray simply by detecting the position of a detecting means.

What is claimed is:

1. A sheet stacking apparatus comprising:

a sheet stacking tray for stacking sheets thereon;

a first abutting member for abutting against an upper surface of the sheets stacked on said sheet stacking tray;

a second abutting member for abutting against an underside of the sheets stacked on said sheet stacking tray; and a sensor for detecting a position of said first abutting member, wherein said first abutting member operates in operative association with a rotating operation of said second abutting member, and wherein said sensor detects a presence or absence of the sheets on said sheet stacking tray in accordance with a rotating movement of said first abutting member.

2. A sheet stacking apparatus according to claim 1, wherein said first abutting member and said second abutting member are shaped into a guide shape so that when the sheets are inserted into said sheet stacking tray from a direction opposite to a sheet conveying direction, the sheets may be inserted between said first abutting member and said second abutting member.

3. A sheet stacking apparatus according to claim 1, wherein when said second abutting member abuts against the underside of the sheets on said sheet stacking tray, said first abutting member moves away from a sheet stacking surface of said sheet stacking tray.

4. A sheet stacking apparatus according to claim 1, wherein said sensor detects the position of said first abutting member for abutting the upper surface of the sheets stacked on said sheet stacking tray, thereby detecting that an amount of the sheets stacked on said sheet stacking tray has reached a predetermined amount.

5. A sheet stacking apparatus according to claim 1, wherein said second abutting member has its tip end reaching an inner side of a stacking wall for supporting a trailing edge of the sheets on said sheet stacking tray with a downstream side with respect to the sheet conveying direction as a center of pivotal movement.

6. A sheet stacking apparatus according to claim 1, wherein when the sheets are not stacked on said sheet stacking tray, said first abutting member and said second abutting member intersect with each other.

7. An image forming apparatus composing:

an image forming portion for forming images on sheets;

a discharging member for discharging the sheets on which the images have been formed by said image forming portion;

a sheet stacking tray for stacking thereon the sheets discharged by said discharging member;

a first abutting member for abutting against an upper surface of the sheets stacked on said sheet stacking tray;

a second abutting member for abutting against an underside of the sheets stacked on said sheet stacking tray; and a sensor for detecting a position of said first abutting member, wherein said first abutting member operates in operative association with a rotating operation of said second abutting member, and wherein said sensor detects a presence or absence of the sheets on said sheet stacking tray in accordance with a rotating movement of said first abutting member.

* * * * *

UNITED STATES PATENT AND TRADEMARK OFFICE

CERTIFICATE OF CORRECTION

PATENT NO. : 7,270,324 B2
APPLICATION NO. : 10/875214
DATED : September 18, 2007
INVENTOR(S) : Atsushi Ogata et al.

It is certified that error appears in the above-identified patent and that said Letters Patent is hereby corrected as shown below:

COLUMN 1:
Line 18, “intends” should read --tends--.

COLUMN 3:
Line 38, “part” should read --past--.

COLUMN 4:
Line 18, “becomes” should read --is detected--.

COLUMN 5:
Line 48, “detects,” should read --detects the sheets,--.
Line 50, “detect.” should read --detect the sheets.--.

COLUMN 6:
Line 60, “composing:” should read --comprising:--.

Signed and Sealed this

Twentieth Day of May, 2008

JON W. DUDAS
*Director of the United States Patent and Trademark Office*